United States Patent [19]

Garmong

[11] Patent Number: 4,473,338

[45] Date of Patent: Sep. 25, 1984

[54] CONTROLLED WELL PUMP AND METHOD OF ANALYZING WELL PRODUCTION

[76] Inventor: Victor H. Garmong, R.D. #1, Kennerdell, Pa. 16374

[21] Appl. No.: 187,132

[22] Filed: Sep. 15, 1980

[51] Int. Cl.[3] ..... F04B 49/00

[52] U.S. Cl. ..... 417/12; 307/141; 318/447; 318/484; 417/44; 417/63

[58] Field of Search ..... 307/141, 141.4; 318/447, 484; 166/64, 65 R, 66, 369, 105, 68.5; 417/1, 12, 33, 43, 44, 45, 63, 20, 22, 42

[56] References Cited

U.S. PATENT DOCUMENTS

| | | | |
|---|---|---|---|
| 2,456,456 | 12/1948 | Smith | 166/369 X |
| 3,966,358 | 6/1976 | Heimes et al. | 417/44 X |
| 4,024,864 | 5/1977 | Davies et al. | 417/45 X |
| 4,110,632 | 8/1978 | Wyland | 307/141 X |
| 4,145,161 | 3/1979 | Skinner | 417/45 X |
| 4,181,911 | 1/1980 | Black | 307/141 X |
| 4,209,258 | 6/1980 | Oakes | 417/43 X |
| 4,224,530 | 9/1980 | Simcoe et al. | 307/141 |

*Primary Examiner*—Edward K. Look
*Attorney, Agent, or Firm*—Carothers & Carothers

[57] ABSTRACT

In a well such as an oil well, a timer connects a power source to the motor which drives the well pump for timed energization and de-energization periods. The timer consists of an electronic programmable timer having a stored program data processor for processing digital information and with capabilities to variably enter time program data into the processor to selectively energize and de-energize the pump motor for any desired time intervals for each day and the time intervals for each day of the week may be programmed differently. When the pump motor is provided in the form of an electric motor, a power transducer is connected to the power source energizing the motor to continually monitor line voltage and current and provide a true power output signal representative of the phase angle between the line voltage and line current. The power supplied to the pump motor is switched off when the wave form of this true power signal attains preselected minimum or maximum peak values corresponding respectively to when the well is pumped off or the pump motor is overloaded. This true power output signal can be further analyzed by a computer programmed to analyze the wave form in relation to well production to provide well production analysis results.

5 Claims, 6 Drawing Figures

CONTROLLED WELL PUMP AND METHOD OF ANALYZING WELL PRODUCTION

BACKGROUND OF THE INVENTION

The present invention relates generally to timers and more particularly to the art of controlling the pumping of a well such as an oil well or other fluid deep wells.

While the discussion herein of the present and the prior art relates to the pumping of oil wells, it should be borne in mind that the apparatus of the present invention may be utilized to control devices other than well pumps, and further that the apparatus of the present invention may be utilized to control pump motors other than electrical pump motors, such as natural gas pump motors.

With the depletion of natural gas and oil in the American oil fields, it became necessary to use secondary and tertiary methods of production in addition to the natural production of old stripper wells. There are many different methods of secondary and tertiary recovery. For example, the use of water flooding has been effective in some geographical areas, and where water flooding was found not to be effective, the industry has used different agents and additives to produce a drive of the oil to the well that is compatible with the surrounding sand. Air pressure, natural gas pressure and other gases have also been used in different combinations of producing wells and injection wells to obtain production. One of the more recent methods used for secondary recovery is called hydrofracturing, wherein a high pressure is placed on the sand through the use of pumps, this pressure being high enough to fracture or crack the sand, to allow oil to flow more freely into the well.

Almost all oil-bearing sands or strata are unique and may vary from one location to another in permeability, porosity, resistivity, conductivity and rock pressure or gas pressure in the sand. With all these above-outlined variables, a need is established for a well pump control for extracting the oil which is highly flexible in its control capabilities as well as being able, in some cases, to respond to other commands to increase, retard, or stop the rate of flow. In addition, many oil fields utilize a large number of wells, and the present inventor has further discovered in this regard that there is a need for not only local but remote control for monitoring and changing production on each individual well to respond to the recovery method being utilized for optimum performance. In fact, it has been discovered that by varying the pumping cycle of the well, pumping cycles can be increased by as much as 50%, thus bringing about the need for an almost infinitely variable pump controller.

Current controllers on the market which are provided to handle this application are made up of standard electro-mechanical timers with varying means of adjustment. Some are 24 hour timers, some are 24 hour cycle timers with a minute setting of 15 minutes off and 15 minutes on. Others are 7 day timers with skip-a-day option available. Yet others are percentage timers with time on and off expressed in percent of 24 hours. None of these prior art timers are programmable for multifunction capability making it necessary at times to change timers as a well changes its production characteristics. Present timers utilize electro-mechanical motors and coils for timing and switching which are susceptible to moisture and corrosive atmospheric contamination which results in short life for such timer units.

Also, transients from lightning are a factor in many failures as well as voltage regulation, phase unbalance and poor frequency regulation. Many oil companies generate their own power, and in some situations this has created a problem in maintaining an acceptable or clean power output without harmonics on the AC power which result in premature failures of the prior art timers. None of the prior art timers can respond to an external output and change its scheduling accordingly. In the event of power failure or shutdown, the prior art pump controllers must be reset to proper time again. Nor do the prior art timers have the ability to communicate to a local or remote location, nor are they capable of being reset or changed from a remote location. In addition, many of the prior art timers must also have their coils and clock motors changed to handle different voltages, which may be experienced throughout a given oil field. In addition, the pump controllers of the prior art are not capable of analyzing the production results and capabilities of a given well.

SUMMARY OF THE INVENTION

The controlled well pump of the present invention includes a timer connecting a power source to the well pump motor for timed energization. The timer consists of an electronic programmable timer having stored program data processor means for processing digital information and means to variably enter time program data to selectively energize and de-energize the pump motor for desired time intervals. The programmable timer may be programmed to not only selectively energize and de-energize the pump motor during different desired time intervals or at selected times of day of any given 24 hour period, but it may further be programmed to provide different timing for different days of the week.

The power supply for the programmable timer is further preferably backed up with a rechargeable battery connected to energize the programmable timer in the event of power supply failure.

In a variation embodiment of the control of the present invention, a radio link means may be connected to the programmable timer for transmitting data output information from the timer to a remote receiver and for receiving timed program data from a remote transmitter to program the programmable timer from remote locations.

In yet another embodiment of the present invention, when the pump motor is supplied in the form of an electric motor, a power transducer is connected to the power source energizing the motor to continually monitor the line voltage and current, and to provide a true power output signal representative of the phase angle between the line voltage and the line current. A circuit is provided to receive this true power output signal and is further adapted to switch off the power supply to the pump motor when the waveform of the signal attains preselected minimum or maximum values corresponding to when the pump motor is underloaded due to well pump off, or to when the pump motor is overloaded due to well pump binding, etc., respectively.

In yet another embodiment of the present invention, a recorder is provided to record the waveform of the true power output signal, and in yet another embodiment, a computer may be connected to receive this true power output signal and is programmed to analyze the waveform of this output signal in relation to well production and these results are displayed on a computer terminal having a printer or a CRT display, for example.

The programmable timer used to control the well pump of the present invention itself may be utilized in applications other than controlling a well pump, and may be utilized to control power supplies to other equipment. The timer includes a central processing unit for computer processing of stored program data, a read only memory for storing a program including a plurality of instructions for the central processing unit, a random access memory for storing variable time input data for the central processing unit, input switches and ports for entering time input data into the random access memory, a timing circuit to provide time and clocking for the central processing unit, a display driver and read out to display selected input and stored information for the central processing unit, and relay means for connecting and disconnecting the electric power source to and from an electrical load.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENT

Figure 1:
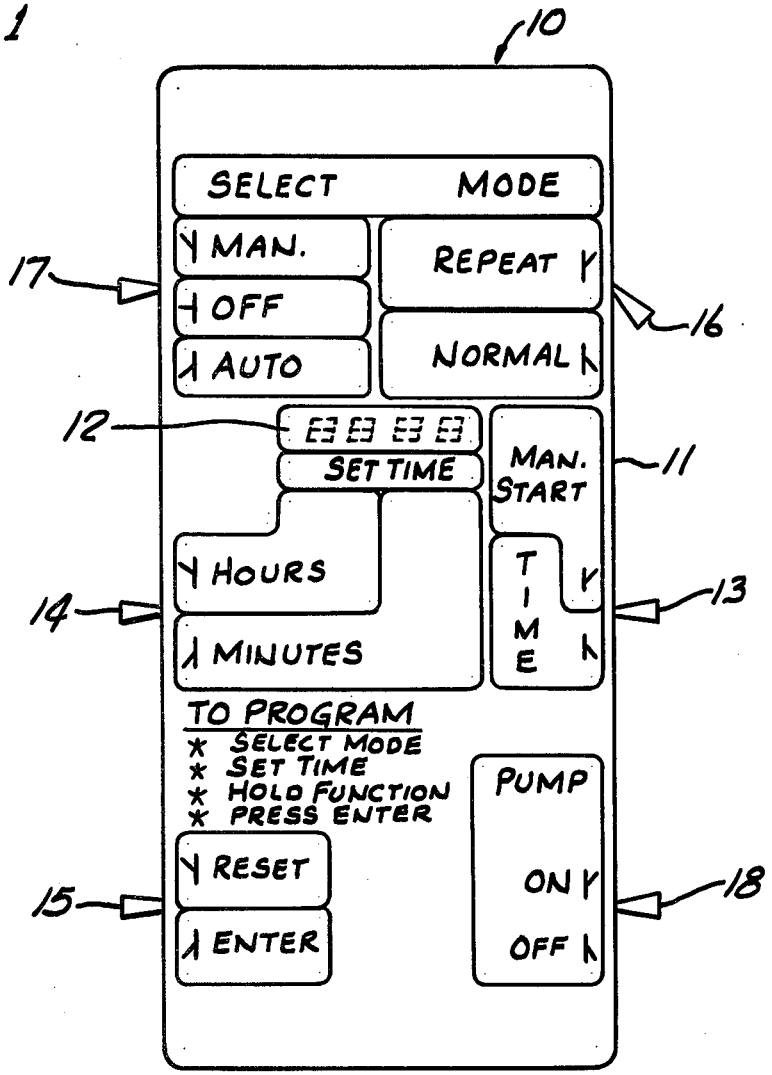
FIG. 1 is a plan view of the face of the programmable timer of the present invention.
Figure 2:
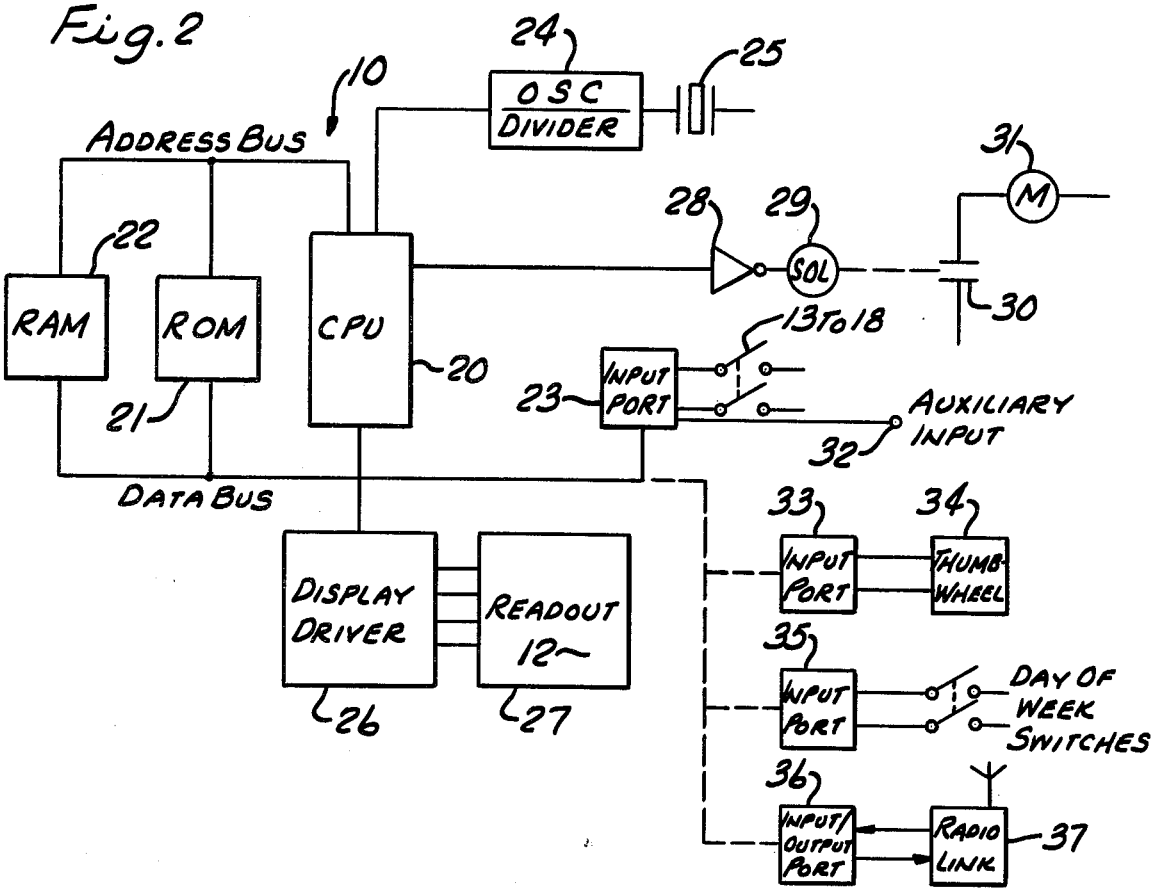
FIG. 2 is an electronic block diagram illustrating the internal electronic schematic of the timer illustrated in FIG. 1.

Referring to FIG. 1, the pump control programmable timer 10 is provided with a housing 11 which stores the electronics for the programmable timer. The electronics for the timer are schematically illustrated in FIG. 2.

The timer 10 is provided with an LED display 12 which displays not only variable time data which is stored in the computer memory of the timer, but also time data prior to entering the same into the computer memory of the timer 10 for verification.

In order to set the correct military time in the timer, switch 13 is deflected downwardly to display the time stored within the memory of the timer 10. If the time displayed is not correct, switch 14 is deflected upwardly to set the proper hours and downwardly to set the proper minutes, in the same manner as a digital watch is set, which will be displayed on LED display 12 in a fashion similar to a digital watch. When the proper time has been set on display 12 with switch 14, time switch 13 is held in the DOWN or time position at the same time switch 15 is pressed downwardly, which enters the correct time information into the memory. To check the time stored in the memory, one need only thereafter press the time switch 13 downwardly, and the correct time will appear on the LED display 12.

Switch 17 is illustrated in the OFF position, and may be switched either upwardly to the MANUAL position or downwardly to the AUTO position. The manual mode of operation is for a 24 hour cycle only. It must be reset using reset switch 15 in the upward position for the next or succeeding 24 hour cycle starting at the time of reset. In the AUTO or automatic mode of operation, it is a continuous 24 hour operation day after day, ending at 24 hours, or Midnight, unless the week module, described hereinafter is utilized for omitting operations on certain days of the week.

Switch 16 is utilized to select the timing mode of either NORMAL or REPEAT. The NORMAL mode allows one to select up to 36 pump on times and 36 pump off times which may be selected at any time in a given 24 hour cycle. The capability of selecting 36 pump on times and 36 pump off times is, of course, a variable function which depends upon the capabilities of the computer memory of the timer 10.

The REPEAT mode allows one to select the length of time pumping and the length of time not pumping, which will be repeated in those increments selected, as low as one minute on, and one minute off, for 24 hours.

If switch 16 is in the NORMAL mode position as indicated in FIG. 1, one sets the pump on time by first setting the desired military time one wants the pump to start pumping on the LED display 12 in the aforedescribed manner with switch 14. Then switch 18 is switched to the PUMP ON position, and if the time displayed on LED display 12 is correct, switch 15 is switched to the ENTER position while still holding switch 18 in the PUMP ON position. At this time, the time entered will still be displayed on display 12. When both switches 15 and 18 are released, the display time will have been entered into the computer memory. In order to check the pump on time, one need only push switch 18 to the PUMP ON position to verify the pump on time entered in the memory, and this pump on time will be displayed on display 12.

To set the time at which one desires the pump to turn off, the desired military pump off time is set on display 12 by the use of switch 14 as previously described. Switch 18 is held down to the PUMP OFF position and simultaneously therewith, if the display time is still correct, switch 15 is pushed to the ENTER position, and when both switches 15 and 18 are released, the correct pump off time is entered into the computer memory of the timer 10. To verify the pump off time selected, one need only thereafter push switch 18 to the PUMP OFF position.

In the repeat mode, switch 16 is switched upwardly to the REPEAT position. In order to set the pump on time, switch 14 is again manipulated as aforedescribed, this time to enter the length of time one wants the well to pump, such as 0001 for one minute or 0100 for one hour, instead of setting actual times, as was done previously in the NORMAL mode. When the desired length of pumping time has been displayed on LED display 12, switch 18 is pressed to the PUMP ON position, and if the correct time interval is displayed on display 12, switch 15 is pressed to the ENTER position at the same time switch 18 is still being held in the PUMP ON position, in order to enter this pumping time into the computer memory of timer 10. In order to check or verify this pumping time interval, one need only push switch 18 to the PUMP ON position and the pumping time interval entered into the memory should appear on the LED display 12.

To set the pump off time in the repeat mode, switch 16 is still maintained in the upper REPEAT position, and one enters the length of time he wants the well stopped, such as 0001 for one minute or 0100 for one hour, with switch 14 as previously described, until the proper time interval is displayed on display 12. Switch 18 is then moved to the PUMP OFF position and simultaneously if the display on display 12 is correct, switch 15 is pushed to the ENTER position. When both switches are released, the pump off time interval is entered into the memory of the computer for timer 10. Again, in order to verify this pump off time, one need only push switch 18 alone to the PUMP OFF position and the pump off time stored within the memory of timer 10 will be displayed on display 12. In this repeat mode, the pump will thus repeatedly be switched on for the selected time interval and then switched off for the selected pump off time interval.

The MANUAL START position for switch 13 permits one to manually start the pump for repairs or the like when an attendant is at the well.

When one switches switch 17 from MANUAL to AUTO or switches switch 16 from REPEAT to NORMAL, the timer 10 assumes one is selecting a different mode of operation and will automatically erase the program that was previously stored in the memory. It will not erase memory going from MANUAL to OFF and back to MANUAL, or from AUTO to OFF and back to AUTO. This allows one to switch switch 17 to the OFF position and utilize switch 13 to manually operate the well without erasing the current program in the memory. Switching switch 16 from the REPEAT mode to the NORMAL mode will not erase programming for either mode of operation until new data is entered, allowing one to switch back and forth without programming.

One may inspect what is in the variable time data memory in the selected mode of operation simply by pressing the desired button. For example, to inspect pump on data in the memory in the NORMAL mode, switch 16 is positioned in the NORMAL position and switch 18 is pressed to the PUMP ON position. The first programmed pump on time will appear on LED display 12. If this is the only time programmed in the memory, this time will keep appearing on the display each time switch 18 is pressed to the ON position. If there are several times programmed into the computer memory, each time one presses switch 18 in sequence to the PUMP ON position, it will step to the next programmed time, until a 24 hour period has been completed br stepped off.

FIG. 2 schematically illustrates in the form of a block diagram the electronic circuitry contained within timer 10. Timer 10 is an electronic solid state programmable timer having a stored program data processor for processing digital information and includes central processing unit 20 for computer processing of stored program data, read only memory 21 for storing a program including a plurality of instructions for the central processing unit, a random access memory 22 for storing variable time input data for the central processing unit, input port 23 for input from switches 13 through 18 (which are also illustrated in FIG. 1) for entering time input data into the random access memory 22. A timing circuit 24 provides time and clocking or a clock pulse for timing for central processing unit 20 and the oscillator within timing circuit 24 is accurately timed with crystal 25.

Display driver 26 and read out 27 (which also includes LED display 12) is provided to display selected input and stored information for the central processing unit as previously described in connection with the operation of the timer illustrated in FIG. 1.

A relay means in the form of amplifier 28, solenoid coil 29 and solenoid contact 30 are provided for connecting and disconnecting an AC electric power source to and from AC pump motor 31 on signal commands from the central processing unit.

All the individual described components, and those described hereinafter, are conventional off-the-shelf electronic components.

Input ports 33 and 35, input/output port 36, thumb wheel switches 34, the day of week switches, and radio link 37 are additional add-on items for timer 10 which render the timer even more sophisticated. Thumb wheel switches 34 are merely used in substitution of the step time setting function carried out by a switch 14. Instead of stepping through time sequences to obtain the correct display time as is done with switch 14 in FIG. 1, with thumb wheel switches 34, four thumb wheel switches are provided and one need only turn each thumb wheel to the correct digit to display the desired military time.

The day of the week switches and input port 35 make up a week module. Seven of these day of the week switches are provided, one for every day of the week. To program this week module, all of the day of the week switches are turned off except the current day. The current day is switched ON and switch 15 illustrated in FIG. 1 is pressed to the ENTER position. The switch 15 is then released and then the remainder of the day of the week switches are turned ON for those days of the week one wants the well to pump.

A counter module may also be added if desired in order to continually count the total number of times pumped or hours pumped from the time started or reset.

Radio link 37 is a transmitter-receiver, which is connected to the programmable timer through input/output port 37 for transmitting data output information from the timer 10 to a remote receiver (not shown) and for receiving time program data from a remote transmitter (not shown) to program the timer in the manner previously described from a remote location. This also permits monitoring of the well and timer from a remote location.

Figure 2A:
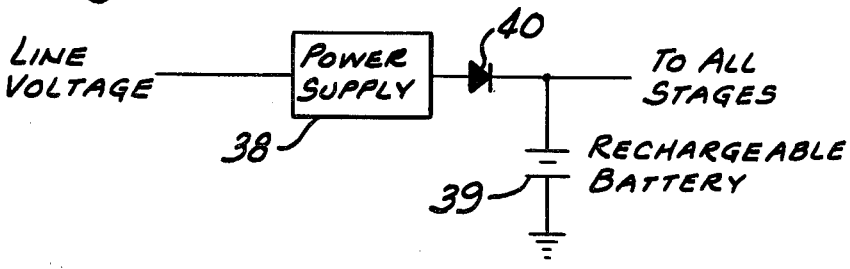
FIG. 2A is an electronic schematic diagram illustrating the power supply for the electronic circuitry illustrated in FIG. 2.

Referring next to FIG. 2A, the power supply 38 is fed from line voltages indicated and feeds or provides the proper voltage supply to all of the stages illustrated in FIG. 2. In case of a power failure, rechargeable battery 39 is provided in the power supply to continually supply electric bias to timer 10 even though no line voltage is present. Diode 40 is provided to prevent feedback of current from rechargeable battery 39 into power supply 38.

Figure 3:
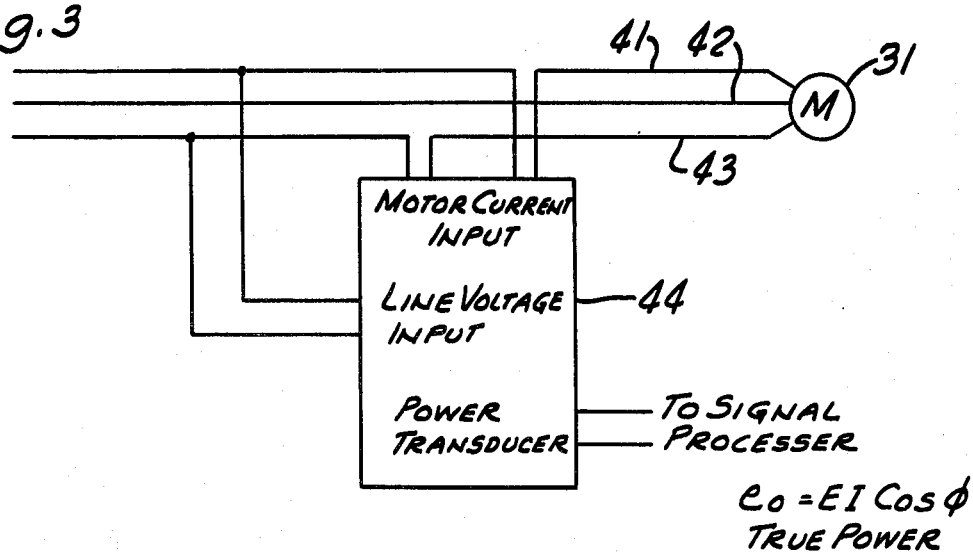
FIG. 3 is a schematic diagram illustrating a power transducer connected to the power source of a pump motor to monitor line voltage and current to provide a true power output signal representative of the phase angle between the line voltage and line current.

Referring next to FIG. 3, electric pump motor 31 is illustrated as a three-phase motor. Power transducer 44 (which for example may be a Hall-watt transducer) is connected to the power source energizing motor 21 to continually monitor line voltage and line current. As indicated at its output, power transducer 44 provides a true power output signal which is representative of the phase angle between the aforesaid line voltage and line current. This signal is represented by the formula $e_o = EI \cos\phi$. This true power signal is fed into the signal processor illustrated in FIG. 4, which is adapted to switch off the power supply to motor 31 when the waveform of the true power or phase angle signal attains preselected minimum or maximum values. An example true power waveform from the output of power transducer 44 is illustrated in FIG. 5.

Figure 4:
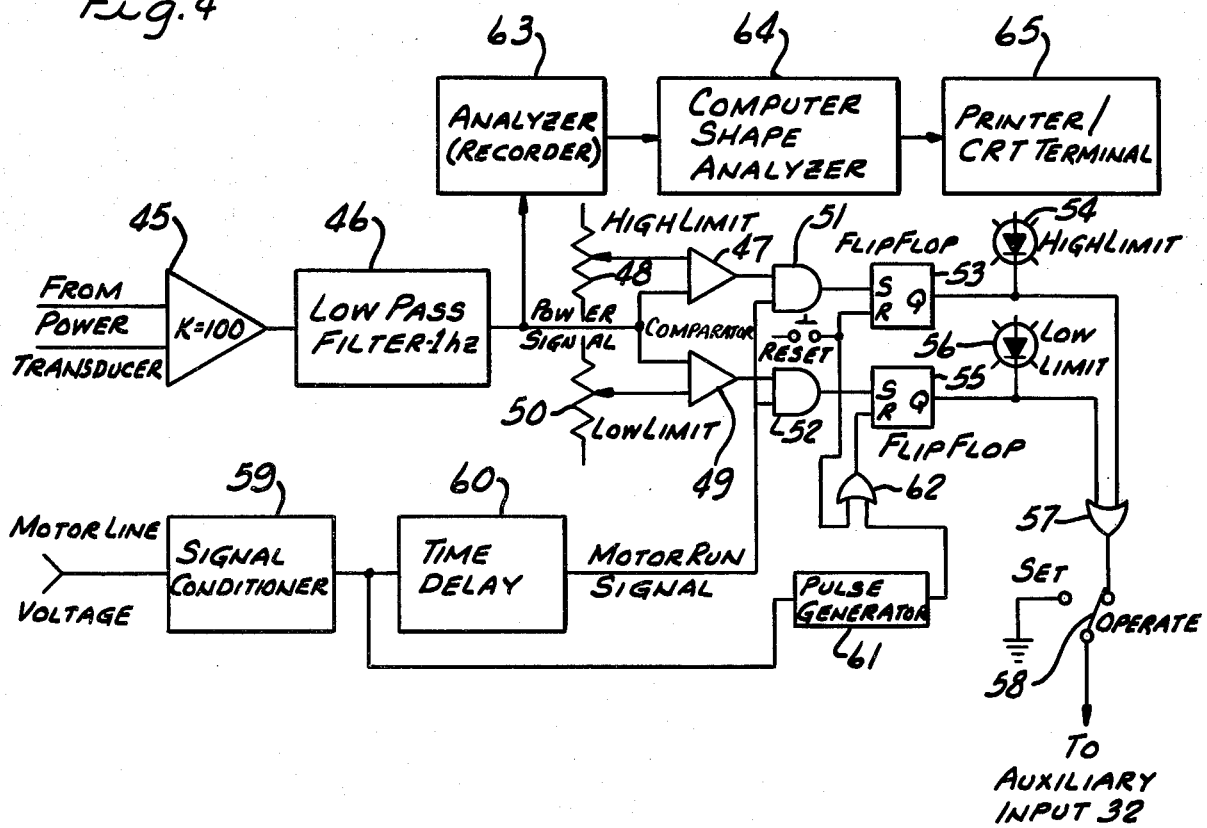
FIG. 4 is a schematic diagram illustrating the electronic circuitry utilized to analyze the true power output signal generated from the power transducer shown in FIG. 3.

Referring to FIG. 4, the signal from the power transducer of FIG. 3 is amplified by amplifier 45, and then passed through low pass filter 46 in order to remove ripple noise and other spurious signals. The signal is then passed on to the comparator made up of amplifiers 47 and 49 and potentiometers 48 and 50 in order to detect when the waveform has attained a preselected minimum or maximum value, at which time the signal processor of FIG. 4 will shut down motor 31.

Figure 5:
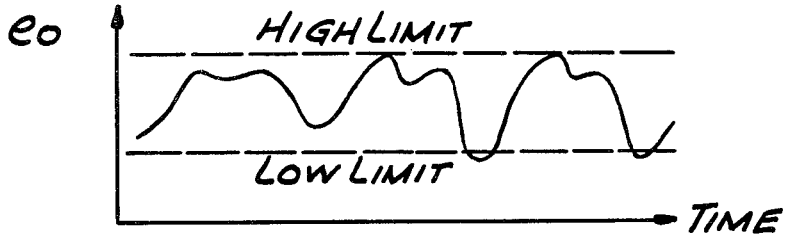
FIG. 5 is a graphical illustration of the waveform of the true power output signal generated from the power transducer shown in FIG. 3.

Again referring to the waveform illustrated in FIG. 5, a typical phase angle or true power waveform is illustrated for a well which is pumping oil. Notice at the beginning of the waveform that the waveform does not exceed the set high limit or the set low limit, and then in the beginning of the third cycle, the waveform dips below the low limit, which means that the true power supplied to motor 31 has gone below the low limit selected by the well operator. This low limit is set by turning potentiometer 50 to the desired level.

At the time that the waveform in FIG. 5 dips below the low limit level, this indicates that the well has pumped off or pumped dry, and thus, it is no longer desirable to continue pumping the well until the next pump on time is attained by timer 10.

At the time the waveform illustrated in FIG. 5 dips below the low limit level set by potentiometer 50, a digital signal is emitted from amplifier 49 to the input of AND gate 52. At the same time, the line voltage of motor 31 is also being monitored through signal conditioner 59 which converts the voltage to logic, and this signal is then passed through time delay 60 to provide a motor run signal for the other input of AND gate 52. The time delay is provided to allow for situations of motor start-up for motor 31, which would cause inaccurate or spurious signals to be transmitted to the signal processor of FIG. 4.

Since the low limit has been exceeded as previously explained, the motor run signal will be applied to one terminal of AND gate 52 and the signals from comparator amplifier 49 will be provided to the other input terminal of gate 52, which will in turn cause AND gate 52 to provide an output signal to flip-flop 55, which is a bi-stable flip-flop. This in turn creates a signal on the output of flip-flop 55 which energizes low limit light emitting diode 56 to indicate that the low limit has been exceeded, and in addition, passes a signal through OR gate 57 which in turn passes through switch 58 and from there goes from input port 23 of timer 10 as illustrated in FIG. 2 by way of auxiliary input 32 and this command signal causes the microprocessor or central processing unit 20 to shut down the power supply to pump motor 31 by way of solenoid 29 and solenoid contact 30. The pump is thus shut down and the pump will remain off until timer 10 commands it to turn on again. At that point in time, the motor line voltage is sensed or monitored in the signal processor of FIG. 4 to initiate pulse generator 61 which passes through OR gate 62 to reset flip-flop 55 to permit the well to continually pump until the timer shuts the pump motor down, or until the well is pumped dry as sensed by the true power signal.

In the event that the waveform illustrated in FIG. 5 exceeds the high limit such that the peak of the waveform rises above the high limit level indicated in the graph of FIG. 1, this would mean that there is a problem with the pumping equipment, for example, there is binding in the well or the pump gear reducer is binding, etc. This high limit is also selected by the well attendant by varying potentiometer 48 of the signal processor illustrated in FIG. 4. Should the peak of the waveform illustrated in FIG. 5 exceed the high limit set by potentiometer 48, a signal will be generated from comparator amplifier 47 and, as previously described in conjunction with AND gate 52, AND gate 51 will activate flip-flop 53 and thereby energize high limit light emitting diode 54 to indicate that the high limit has been exceeded. Again, this signal will pass through OR gate 57, switch 58 to the auxiliary input port 32 of the timer 10 as illustrated in FIG. 2, and cause the central processing unit to shut down motor 31. However, in this instance, such a shut down indicates there is a problem with the pumping equipment, and accordingly, it is desired that the timer 10 does not turn the pump on again until the problem is first corrected by a well attendant. Once the mechanical problem has been corrected, the well can be started up again only after the attendant manually presses the RESET button at the reset input of flip-flop 53 in the signal processor illustrated in FIG. 4 to reset the flip-flop 53.

The signal processor illustrated in FIG. 4 also provides other well production analysis functions. Recorder 63 is provided to actually graphically record the waveform illustrated in FIG. 5 so that one may visually analyze the waveform. Computer 64 analyzes the shape of the true power signal in relation to well production, and displays these analysis results on the computer terminal 65 which may be a printer or a CRT terminal. By properly programming computer 64, the production of any given well can be specifically analyzed so that one may determine how pumping times and equipment must be modified to achieve maximum well production.

While the circuit of FIG. 3 is illustrated for the monitoring of line current and voltage with a three-phase motor 31, it should also be realized that the same results can be accomplished for a two-phase motor.

I claim:

1. A controlled well pump comprising, a well pump, an AC electric motor connected to drive said pump, a timer connecting a power source to said motor for timed energization thereof, said timer consisting of an electronic programmable timer having stored program data processor means for processing digital information and means to variably enter time program data to selectively energize and de-energize said motor for desired time intervals, power transducer means connected to said power source energizing said motor continually monitor the line voltage and current and provide a true power output signal representative of the phase angle between said line voltage and said line current, computer means connected to receive said true power output signal programmed to analyze the waveform of said output signal in relation to well production and malfunction and to display the analysis results therefrom, and including circuit means receiving said true power output signal and adapted to switch off the power supply to said motor when the waveform of said signal attains preselected minimum or maximum values.

2. The controlled well pump of claim 1, wherein said programmable timer is programmed to selectively energize and de-energize said motor for different desired time intervals for different days of the week.

3. The controlled well pump of claim 1, wherein said programmable timer is energized from an electric power supply, said power supply including a rechargeable battery connected to energize said programmable timer in the event said power supply should fail.

4. The controlled well pump of claim 1, including a radio link means connected to said programmable timer for transmitting data output information from said timer to a remote receiver and for receiving time program data from a remote transmitter to program said timer.

5. The controlled well pump of claim 1, including a recorder connected to record the waveform of said true power output signal.

* * * * *